United States Patent [19]

Seiz et al.

[11] 4,187,037

[45] Feb. 5, 1980

[54] WALL SUPPORTING ARRANGEMENT, ESPECIALLY FOR SUPPORTING MINE GALLERY WALLS

[75] Inventors: Rudolf Seiz, H. Rainer Str. 10, 8036 Herrsching (Ammersee), Fed. Rep. of Germany; Lothar Sebastian, Essen, Fed. Rep. of Germany

[73] Assignee: Rudolf Seiz, Herrschin, Fed. Rep. of Germany

[21] Appl. No.: 882,568

[22] Filed: Mar. 2, 1978

[30] Foreign Application Priority Data

Mar. 3, 1977 [DE] Fed. Rep. of Germany ..... 2709242
Sep. 10, 1977 [DE] Fed. Rep. of Germany ..... 2740908

[51] Int. Cl.[2] ..... E21D 11/00

[52] U.S. Cl. ..... 405/150; 52/653; 405/146

[58] Field of Search ..... 61/84; 405/150, 151, 405/146; 52/652, 653, 654, 726, 646, 647, 648, 639, 640, 650, 664, 636, 644

[56] References Cited

U.S. PATENT DOCUMENTS

| | | | |
|---|---|---|---|
| 687,200 | 11/1901 | Conger | 52/653 |
| 843,171 | 2/1907 | Petterson | 52/653 |
| 905,770 | 12/1908 | Tyson | 52/695 X |
| 1,729,741 | 10/1929 | Heltzel | 52/695 |
| 3,381,479 | 5/1968 | Curzio | 61/84 |

FOREIGN PATENT DOCUMENTS

| | | | |
|---|---|---|---|
| 5254 | 12/1879 | United Kingdom | 52/654 |

*Primary Examiner*—Dennis L. Taylor
*Attorney, Agent, or Firm*—Michael J. Striker

[57] ABSTRACT

A wall supporting arrangement, especially for supporting mine gallery walls, comprises a supporting frame for a wall to be supported and including at least two frame elements located in a plane which is transverse to the elongation of the wall and are spaced from one another in this plane, and a plurality of shape-retaining shell-shaped connecting elements distributed along the frame elements and connecting the latter with one another in spacially fixed relationship. The supporting frame may include two such outer frame elements and two such inner frame elements connected with one another. In this case each of the connecting elements includes two shell portions connected with one another and including mounting formations for mounting the four frame elements with one another. The supporting frame may include a plurality of frame portions located laterally adjacent to one another in a circumferential direction of the supporting frame.

27 Claims, 17 Drawing Figures

FIG. 1
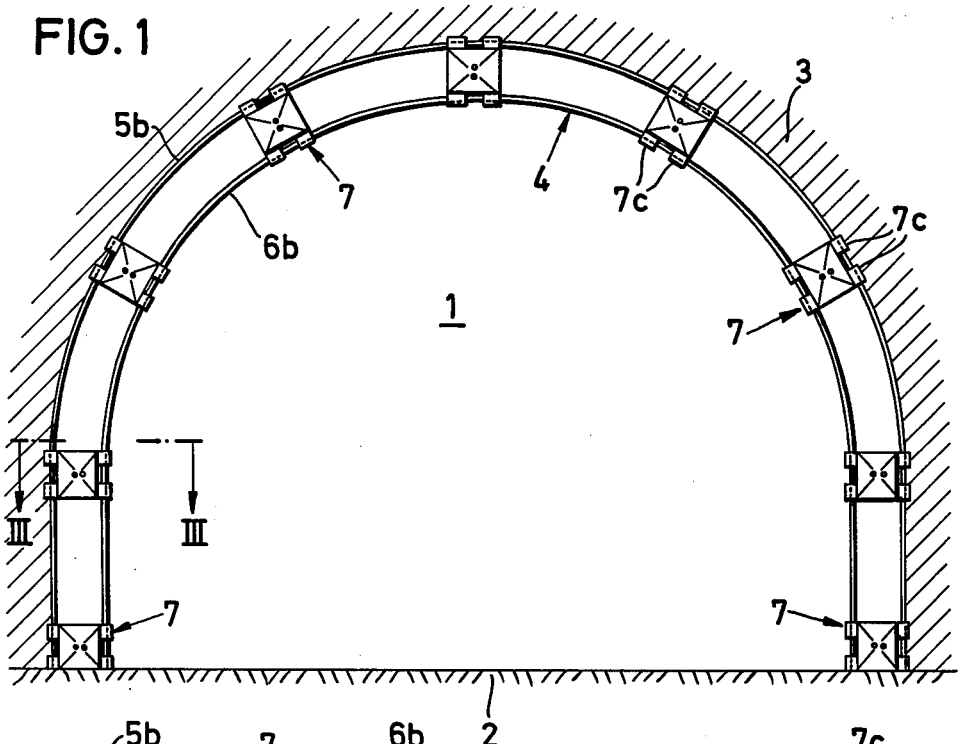
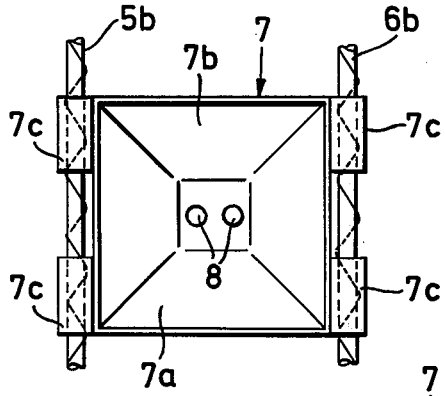
FIG. 2
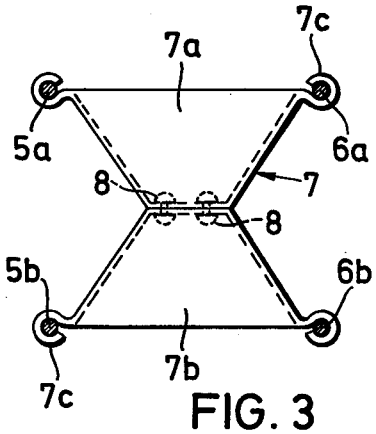
FIG. 3
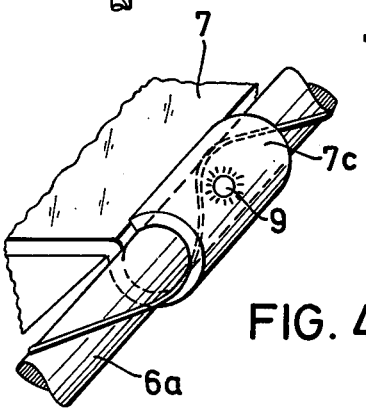
FIG. 4

FIG. 8
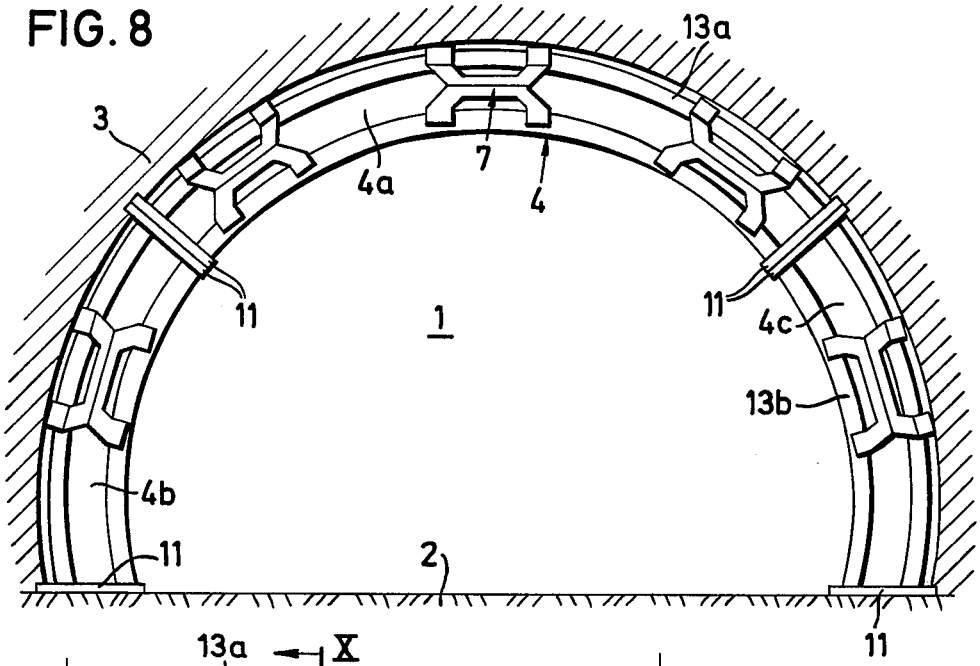
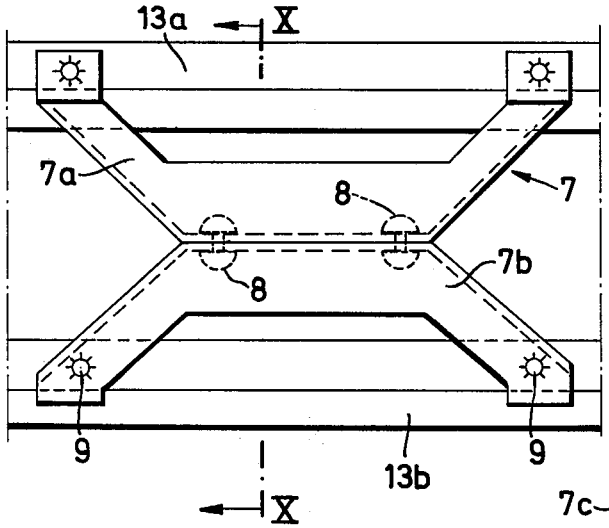
FIG. 9
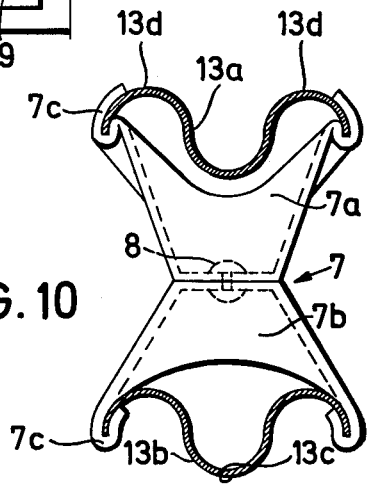
FIG. 10

WALL SUPPORTING ARRANGEMENT, ESPECIALLY FOR SUPPORTING MINE GALLERY WALLS

BACKGROUND OF THE INVENTION

The present invention relates to a wall supporting arrangement, especially for supporting mine gallery walls. More particularly, it relates to a wall supporting arrangement including one supporting frame or a plurality of supporting frame portions.

In wall supporting arrangements for mines, tunnels, or galleries it has been known to utilize I-shaped or trough-shaped frame elements. These known integral frame elements have the disadvantage that when the depth increases and the rock pressure becomes correspondingly greater, it is difficult to distribute increased mass of material over the frame elements in the case of heavier supporting frames so as to maintain satisfactory relationship between expenditures of material or weight per meter and loading of the frame elements during their practical utilization. Heavier frame elements of correspondingly larger cross-section are also difficult to produce by rolling and cannot readily be bent with a sufficiently small radius of curvature for use as curved segments.

Since the frame elements, especially in an arched supporting arrangement are subjected not only to flexing but also to bending, tilting and torsion, especially when they are used in an arched underground passage, wherein these stresses often pass into a plastic deformation range, it is not sufficient, in contradiction to the usual condition in the construction industry, to design frame elements only or substantially with respect to possible high load-bearing capacity, that is to achieve possibly high static values; rather, it is necessary even at the cost of accepting less high static values, to select primarily the shape-retaining capability or shape stability of the frame elements so as to make the latter sufficiently resistant to the above-mentioned complex loads. The shape stability of the frame elements must be such as to withstand not only flexing loads and sharp bending loads, but also to resist tilting forces, as well as high torsional and arching forces.

It has been shown that when one-piece load frame elements are used it is difficult to optimally satisfy all of the above-mentioned requirements in dependence upon one another, inasmuch as the great rock pressure prevailing at increasing depths require utilization of heavier frame elements with correspondingly greater transverse dimensions. Inasmuch as the frame elements with due regard to sufficient shape stability must be thick-walled, even when this does not contribute to an increase of static strength, the relationship between expenditures of material and utilization of material for the carrying capacity or loading capacity of the frame elements becomes the less satisfactory, the greater and stronger the dimensions of the frame elements must be selected to withstand the increased load.

SUMMARY OF THE INVENTION

Accordingly, it is an object of the present invention to provide a wall supporting arrangement, especially for supporting mine gallery walls, which avoids the disadvantages of the prior art.

More particularly, it is an object of the present invention to provide a wall supporting arrangement which involves favorable material expenditures and at the same time has not only good carrying capacity, but also has good shape stability under high load conditions.

Another object of the invention is to provide a wall supporting arrangement whose load-supporting parts can be produced with an optimal construction independently of the limitations imposed by the process of rolling and bending, and which parts can thereafter be assembled in a simple manner and with the aid of simple means directly at the installation site so as to better accommodate them to the local requirements as to their carrying capability and shape-retaining capability as well as to their conformity to the elongation of the mine gallery.

A further object of the present invention is to provide a wall supporting arrangement whose structural elements are so constructed that they can be used as a final support but are also suitable (due to their bonding to concrete which is better than that of conventional rolled-profile elements) to form a self-supporting temporary support structure which is only later coated by concrete so as to form the final supporting structure.

In keeping with these objects, and with others which will become apparent hereinafter, one feature of the present invention is to provide a wall supporting arrangement, especially for supporting mine gallery walls which comprises a supporting frame for a wall to be supported and including at least two frame elements located in a plane which is transverse to the elongation of the wall in spaced relationship with one another in this plane, and connecting means, including a plurality of shape-retaining shell-shaped connecting elements distributed along the frame elements and connecting the latter with one another in spatially fixed relationship.

In such constructions, wherein the supporting frame is formed by two separate elements connected with one another by shape-retaining shell-shaped connecting elements, the frame elements do not become curved and do not deviate to neutral line, it is possible to obtain very high static values defined by the carrying capacity in dependence upon the material expenditures, and therefore to obtain very high shape-retaining capability or shape stability of the construction against flexing, sharp bending, tilting and torsion loads. Since in connection with a great number of the connecting elements distributed over the frame elements, the distance between the frame elements may be correspondingly increased, it is possible to obtain without difficulties substantially small material expenditures with high static values and thereby with substantially great carrying capability, as compared with those of prior art one-piece rolled-profile supporting frames.

The thrusting action caused by flexing load is absorbed by the spatial orientation of the shape-retaining shell-shaped connecting elements, so that, contrary to the known supporting arrangements in which only tensile or compressive forces are absorbed, the supporting frames in accordance with the invention cannot sharply bend and therefore do not more or less suddenly cease their supporting function. The connecting elements are distributed over the frame elements by greater or smaller distances so that a relatively great quantity of material is concentrated in the region of edges, and high-strength, possibly heat-treated, steel is used for forming the frame elements. The arrangement in accordance with the present invention also has the advantage that the material is so distributed with respect to the X axis and Y axis that the moments of resistance in both axes are retained equal or substantially equal, which is necessary for shape-retaining capability or cross-sectional stability of the structural elements against flexing, torsion and sharp-bending loads, as well as for a high resistance to arching and tilting in the arcuate regions of the structure. The stiffness of the arrangement with respect to sharp bending, as well as flexure stiffness, is determined by dimensioning, length and the distance between the shell-shaped connecting elements in the longitudinal direction and therefore the arrangement is better able to accommodate itself to local stress conditions.

The construction of the frame elements or portions of frame elements has the further substantial advantage that they can be assembled with one another in situ so that they can be more easily adapted to the respective local conditions. For bending and cutting of the frame elements suitable devices can be employed which can be readily used for in situ installatiion of the supporting arrangement, and to place and mount the prefabricated shell-shaped connecting elements onto the cut and bent frame elements only simple apparatus is required, for instance spot welding apparatus. In this manner it is possible to adjust the carrying capability and shape-retaining capability of the supporting frame without difficulties directly at the site of utilization by distributing the shell-shaped connecting elements at smaller or greater distances from one another.

The structural parts of the wall supporting arrangement in accordance with the present invention have substantially improved connection with concrete compared to the prior art rolled frame elements, inasmuch as their interface with the concrete (given the same cross-sectional area as a prior-art element) is distributed over a greater number of smaller individual cross-sections and is thus split up into a plurality of interface areas the sum of which is greater than in the prior art. This permits the frame elements of the arrangement to be installed in applications where the supporting frame must be self-supporting but is used only for temporarily supporting the wall in the area adjacent to mine face, whereas the supporting frame is converted only later, e.g. at a substantial distance rearwardly of the mine face, into a permanent lining by applying a coat of concrete thereabout. Because of their specific construction the frame elements form a self-supporting reinforcement of the statically calculated steel concrete structure.

The wall supporting arrangement in accordance with the invention is not limited to the utilization only for underground work, but can also be used to technical and economic advantage in tunnels or galleries.

It is advantageous to embed the frame elements of portions thereof in sprayed-on concrete. This can be preferably done in such a manner that during a first step at least about half of the radial frame element depth is embedded in concrete in sealing relationship with the mine gallery wall, and thereafter during the next step the inner frame element is then also embedded in the concrete.

The several supporting frames can be arranged with spacing in the direction of the mine gallery axis and bolted to one another. It is also possible, instead of the above-mentioned connection or in addition thereto, to connect the supporting frames or the portions thereof with the mine gallery wall by rock anchors which can be connected, in turn, either to the frame elements or to the connecting elements which connect the frame elements with one another.

The novel features of the invention which are considered as characteristic are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a wall supporting arrangement in accordance with one embodiment of the present invention, comprising integral frame elements;

FIG. 2 is an enlarged view showing a connecting element of the wall supporting arrangement, for connecting the frame elements with one another;

FIG. 3 is a plan view of the connecting element shown in FIG. 2;

FIG. 4 is a perspective enlarged view of a section of the connecting element connected with the frame element;

FIG. 8 is a view showing the wall supporting arrangement in accordance with a further embodiment of the present invention, including the frame elements which are constituted by several separate members;

FIG. 9 is an enlarged view showing the connecting element which is used in the arrangement shown in FIG. 8;

FIG. 10 is a view showing a section of the connecting element taken along line X—X in FIG. 9;

DESCRIPTION OF THE PREFERRED EMBODIMENTS

Figure 5:
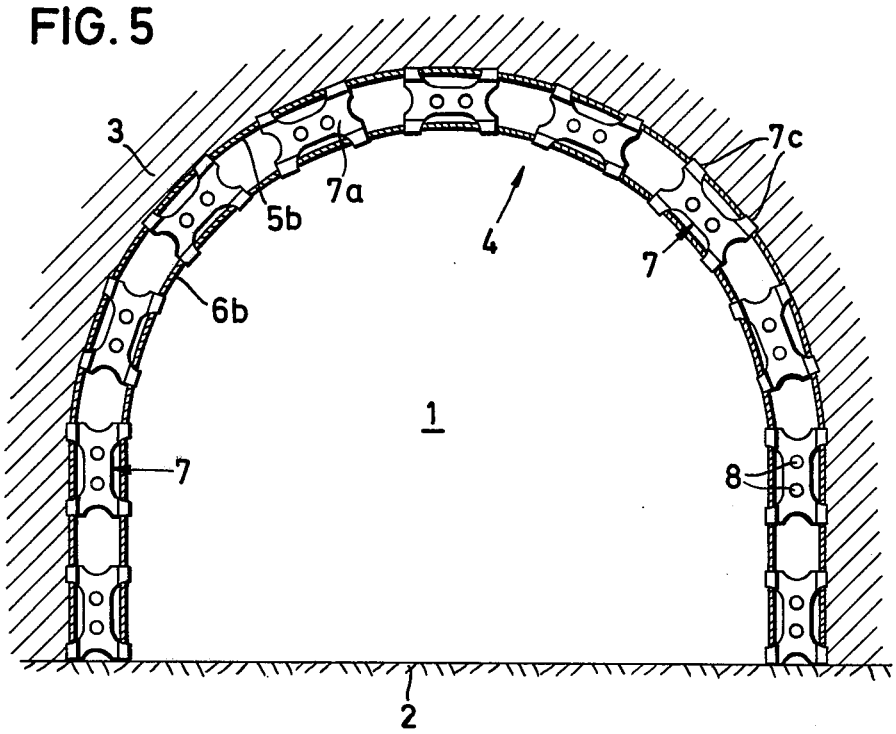
FIG. 5 is a view showing a second embodiment of the wall supporting arrangement including integral frame elements.

A wall supporting arrangement, for instance for supporting mine gallery walls, is shown in the drawing as located in a passage identified by reference numeral 1 which has a floor identified by reference numeral 2 and is surrounded by rock identified by reference numeral 3. The wall supporting arrangement is identified in toto by reference numeral 4.

FIGS. 1–4 show the wall supporting arrangement in accordance with a first embodiment of the present invention. The arrangement has a supporting frame which is formed by two outer and two inner bar-shaped frame elements 5*a*, 5*b*, 6*a* and 6*b*, respectively. The frame elements are constituted by ribbed and heat-treated concrete reinforcement steel. The frame elements extend over the entire length of the supporting frame in the circumferential direction of the latter.

The frame elements 5*a*, 5*b*, 6*a* and 6*b* are spaced from one another by equal distances as considered both in a direction of the elongation of the wall and in a direction transverse to the direction of elongation. The frame elements are connected with one another by shape-retaining shell-shaped elements 7, in spatially fixed relationship. The connecting elements 7 are distributed over the frame elements in the circumferential direction. The same kind of connecting element 7 supports the lowermost end sections of the frame elements on the mine gallery floor 2.

As can be clearly seen from FIGS. 2 and 3, the shell-shaped connecting element 7 is formed as a doubled mirror-symmetrical shell including two shell portions 7*a* and 7*b* shaped as truncated pyramids. The shell portions 7*a* and 7*b* are connected with one another in the regions of their bottom walls by rivets 8. As shown in FIGS. 2 and 3, the side walls of the shell portions 7*a* and 7*b* are outwardly inclined in the direction from the bottom towards the free outer edges thereof. The walls of the shell portions 7*a* and 7*b* may be also provided with reinforcing formations in order to improve their stiffness. The means for mounting the shell-shaped connecting elements 7 or their portions 7*a* and 7*b* to the frame elements 5*a*, 5*b*, 6*a* and 6*b* is formed as a loop 7*c* provided at a free outer edge of the connecting element 7. The loop 7*c* surrounds the respective frame element in engaging relationship and may be additionally connected thereto by means of weld spots 9, as shown in FIG. 4.

The arrangement shown in FIGS. 1–4 can especially suitably serve as a temporary support which supports the mine gallery wall immediately behind the mine face, and thereafer is embedded with concrete by a spray-on process rearwardly or at a substantial distance from the mine face so as to form the permanent support structure. Since the supporting arrangement is self-supporting, its high carrying capability and shape-retaining capability are fully utilized in the statically stiff steel concrete structure which is formed when the arrangement is embedded in the concrete. The above-described supporting arrangement is preferably, but not exclusively, suitable for lining of tunnels or galleries.

Figure 7:
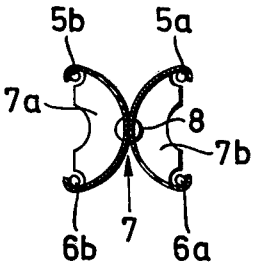
FIG. 7 is a view showing a section of the supporting frame along the line VII—VII of FIG. 6.
Figure 6:
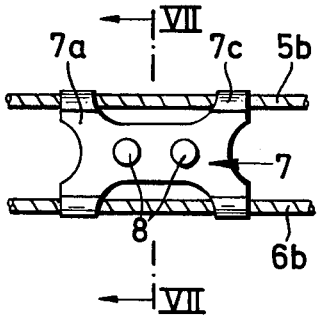
FIG. 6 is a side view of the shell-shaped connecting element.

FIGS. 5–7 show the wall supporting arrangement in accordance with another embodiment of the present invention, which also has a simple construction and is also formed by integral rigid frame elements 5*a*, 5*b*, 6*a* and 6*b* in form of ribbed concrete-reinforcing steel. The frame elements are connected in spatially fixed relationship by the shell-shaped element 7 distributed over the frame elements by small distances from one another. The shell-shaped connecting elements 7 in accordance with this embodiment are also constituted by two shell portions 7*a* and 7*b* which are connected with one another by rivets 8 and are manufactured by pressing from sheet metal. The shell portions are trough-shaped both in a transverse direction, and in the longitudinal direction. The convex bottoms of the pressed shell portions 7*a* and 7*b* facing toward one another are aligned in a plane which is transverse to the direction of elongation of the wall to be supported. The engaging connection of the mounting section 7*c* with the frame elements 5*a*, 5*b*, 6*a* and 6*b* is performed in accordance with this embodiment by squeezing, such that the loop-shaped mounting section 7*c* is plastically deformed about and into conformance with the outer contour of the ribbed bar-shaped frame portions and therefore forms with them a completely rigid connection both in the longitudinal direction and in the circumferential direction.

The thus-constructed arrangement is also especially suitable for the cases wherein it is located immediately behind the mine face and serves only as a temporary support prior to subsequent one layer or multilayer coating with concrete, e.g. in accordance with a spray-on process. It is evident that the supporting arrangement especially in accordance with this embodiment can be easily assembled at the site of its utilization so that it can be readily adapted to local conditions. This is true not only for adaptation of the arrangement of the cross-section of a space to be supported, i.e. the in situ cutting of the elements to the required length and their bending, but it is also true for the spatial connection of the frame elements which is performed by mounting of the shell-shaped connecting elements in accordance with the form of loading and mine structural conditions by specific location of the connecting elements in the circumferential direction of the frame elements at specific distances from one another.

As can be seen in FIG. 5, the shell-shaped connecting elements 7 can be located so close to one another that in some cases they can overlap one another in a nested relationship. As shown in FIG. 6 the shell-shaped connecting element 7, contrary to the first-mentioned embodiment, has a greater dimension in circumferential direction of the frame elements than its dimension in a direction transverse to the circumferential direction. The distance between the two end mounting portions on the frame elements and the distance between the successive shell-shaped connecting elements determines both the flexural stiffness and the stiffness against sharp bending (i.e. kinking) of the supporting frame, and more particularly the kinking length which is defined by the end mounting sections.

The wall supporting arrangement in accordance with the third embodiment of the invention shown in FIGS. 8, 9 and 10, differs from the two before-described embodiments, on the one hand, by the fact that the supporting frame 4 is divided into three separate members 4*a*, 4*b* and 4*c*. The members 4*b* and 4*c* are side members, whereas the member 4*a* is located intermediate the members 4*b* and 4*c*. This embodiment also differs in that the integral frame elements 13*a* and 13*b* are formed by sheet plates which are pressed so as to assume substantially sine-wave cross-section. As can be seen from FIG. 10, the frame elements have a cross-section including an arcuate section 13*c* facing inwardly toward the passage and flanking arcuate sections 13*d* facing outwardly away therefrom. The frame elements are mirror-symmetrical with respect to their Y axis and have widths exceeding the depths thereof. The frame elements in this embodiment can also be constituted by more or less heat-treated steel sheet.

As can be seen from FIG. 10, the frame elements 13*a* and 13*b* are not only identical with one another, but extend in the same direction in correspondence with their shape, and are connected with one another in spatial relationship by the connecting elements 7 which space them from each other, as considered in a plane transverse to the direction of the elongation of the wall to be supported, by a distance which is greater than the width of the frame elements.

Even though FIG. 10 shows the preferable construction and arrangement wherein the frame elements 13*a* and 13*b* are wave-like, it is possible in some cases to utilize frame elements which have different shapes and which are in some cases arranged not in the same direction but in opposite direction relative to one another, when this is required by specific loading conditions. The shell-shaped connecting elements 7 substantially correspond to the connecting elements of the arrangement in accordance with the first embodiment of the invention with the distinction that in the embodiment shown in FIGS. 8–10 each of the shell-shaped connecting elements has eight mounting portions 7*c* which surround the frame elements 13*a* and 13*b* in a claw-like manner. The rigid connection is also performed by spot welding, whereas the shell portions 7*a* and 7*b* are connecting with one another by rivets 8 in the region of their bottom.

Reference numeral 11 identifies flange portions provided at both circumferential ends of the separate frame elements and connected with the latter by buttwelding. The individual frame members 4*a*, 4*b* and 4*c* of the frame elements are thereby laterally supported by one another in the circumferential direction of the arrangement. The flange plates 11 can be connected with one another by conventional means, such as by bolts which are not shown in the drawing. The connection in the region of the flange portions 11 can, however, be omitted when the supporting frame, for instance in tunnels or galleries, is used only as a temporary support which is to be thereafter reinforced by concrete at a substantial distance from the mine face.

FIGS. 11–16 show the wall supporting arrangement in accordance with the fourth especially advantageous embodiment of the invention. In this embodiment the supporting frame is a rigid one-piece element; however, it can also be composed of several separate frame members as shown in the embodiment of FIG. 8.

The supporting frame 4 consists of two outer and two inner frame elements constituted by suitable, in this case smooth, concrete-reinforcement steel having a round cross-section. The frame elements are identified by reference numerals 5*a*, 5*b*, 6*a* and 6*b* respectively, and extend in the circumferential direction of the supporting frame 4 over its entire length. The frame elements are spaced from one another by equal distances both in the direction transverse to the axis of the passage and parallel to the latter. The frame elements 5*a*, 5*b*, 6*a*, 6*b* are connected with one another in spatially fixed relationship by means of the shape-retaining shell-shaped connecting elements 7. Even though in the case of FIG. 11 the shell-shaped connecting elements 7 are spaced from one another in the circumferential direction by equal distances, it is to be understood that it is possible that the distances between the connecting elements 7 may be varied in accordance with loading conditions, for instance so that smaller distances are provided in the regions where greater loads can be expected to act upon the supporting arrangement.

Figure 11:
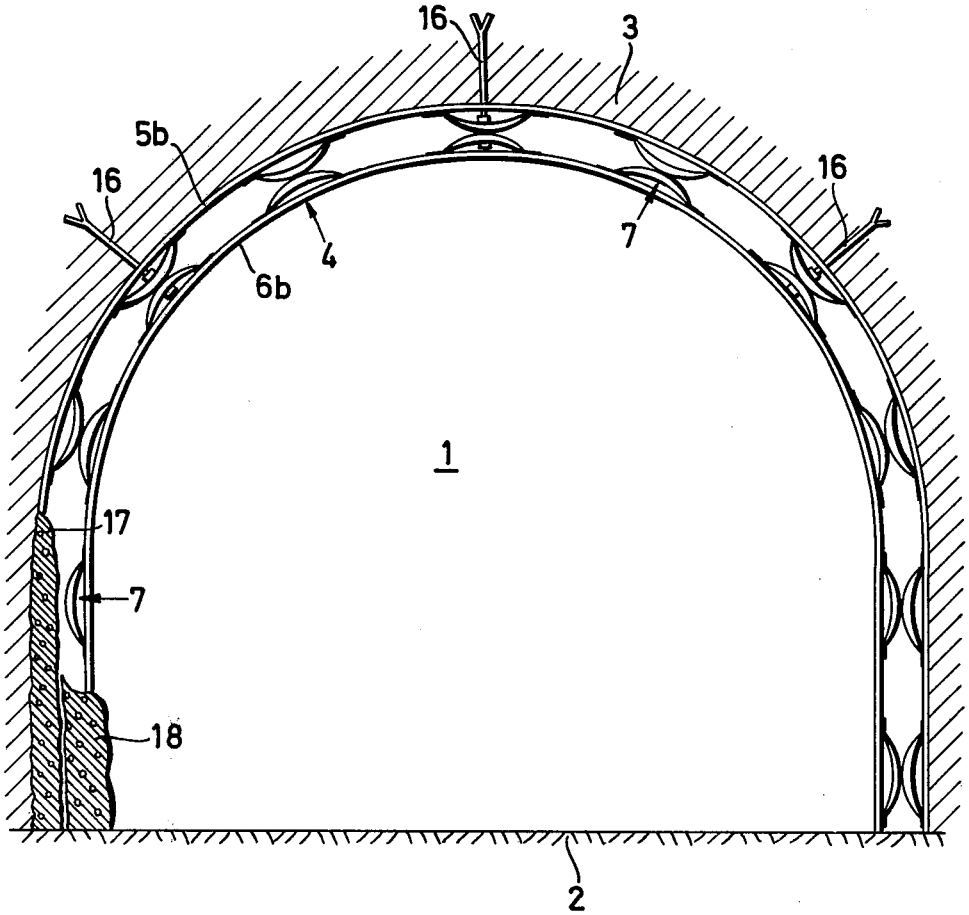
FIG. 11 is a view showing the wall supporting arrangement with an integral rigid supporting frame.

As can be seen from FIG. 11, the frame elements can be additionally anchored in the surrounding rock 3 by means of an anchoring member 16, so as to improve their stability against shifting. The additional anchoring of the frame elements by means of the conventional anchoring members 16 is recommended especially in the cases when the supporting frame 4 is used as a temporary, and at the same time self-supporting support structure which will be only later embedded in concrete in the region of the mine face and only thereafter forms the permanent structure. The embedding can be effected by spraying concrete onto the frame elements to sealingly connect them with the rock 3 so that steel concrete frame sections are formed wherein the supporting frame 4 forms a self-supporting static reinforcement.

It is, however, also advantageous in many cases to anchor the supporting frame 4 in the rock at a distance from the mine face by means of two successive operational steps. In the first step the outer half of the radial width of the supporting frame 4 is reinforced by concrete by means of a spray-on process, and thereupon in the second step the second inwardly located frame elements are concreted by means of the same process. In the left region of FIG. 11 the thus-formed outer concrete shell is indentified by reference numeral 17, and the thereupon applied inner concrete shell is identified by reference numeral 18. It can be seen that the longitudinal interface between the two concrete shells is located substantially in the region of the location of the shell-shaped connecting elements 7.

The rock anchoring members 16 can be of any known prior-art type and connected with the supporting arrangement either in the region of the shell-shaped connecting elements 7 by means, for instance, of bolts, or they may be directly connected with the frame elements in the region between two adjacent ones of the connecting elements 7.

Figure 12:
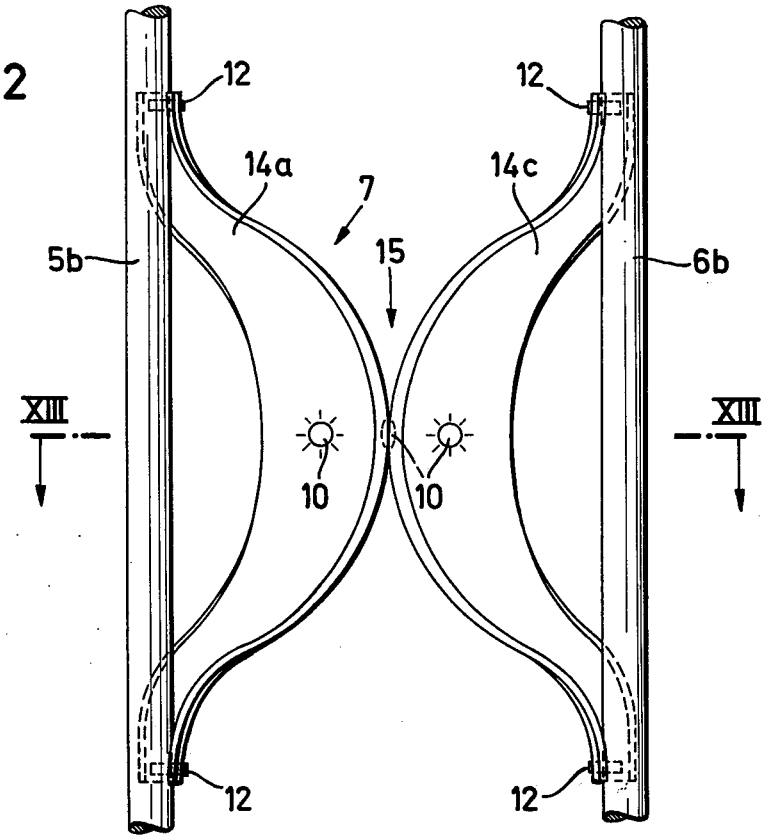
FIG. 12 is an enlarged view of a connecting element which is used in the arrangement shown in FIG. 12.
Figure 13:
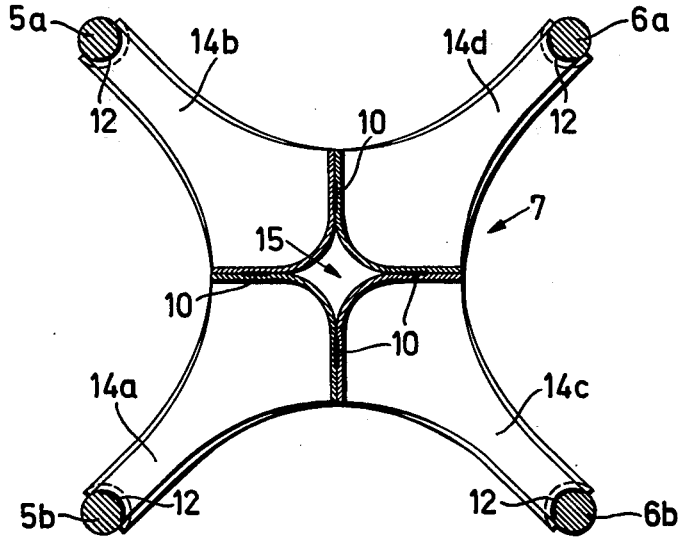
FIG. 13 is a view showing a section taken along line XIII—XIII of FIG. 12.

As can be seen from FIGS. 12 and 13, each of the connecting elements 7 is constituted in this case by four members 14*a*, 14*b*, 14*c* and 14*d* which are arranged crosswise relative to and connected with each other so as to diagonally connect the frame elements with each other. The members 14*a*–14*d* are shell-shaped and convex both in the longitudinal direction and in the transverse direction thereof. Their curved inner walls are rigidly connected with one another so as to form a spatial knot 15. The outer curved walls of the members have end sections which surround the frame members in engaging relationship therewith. The securing is performed by spot welding or line welding 12.

The members 14*a*–14*d* are curved along two axes and identical with one another, and thereby the knot 15 formed by these members is located in the geometrical center of the four frame elements 5*a*, 5*b*, 6*a* and 6*b* connected by the connecting elements 7. The shell portions in this case are centrally symmetrical with respect to the center of the knot 15.

Figures 14, 14A, 15, 16:
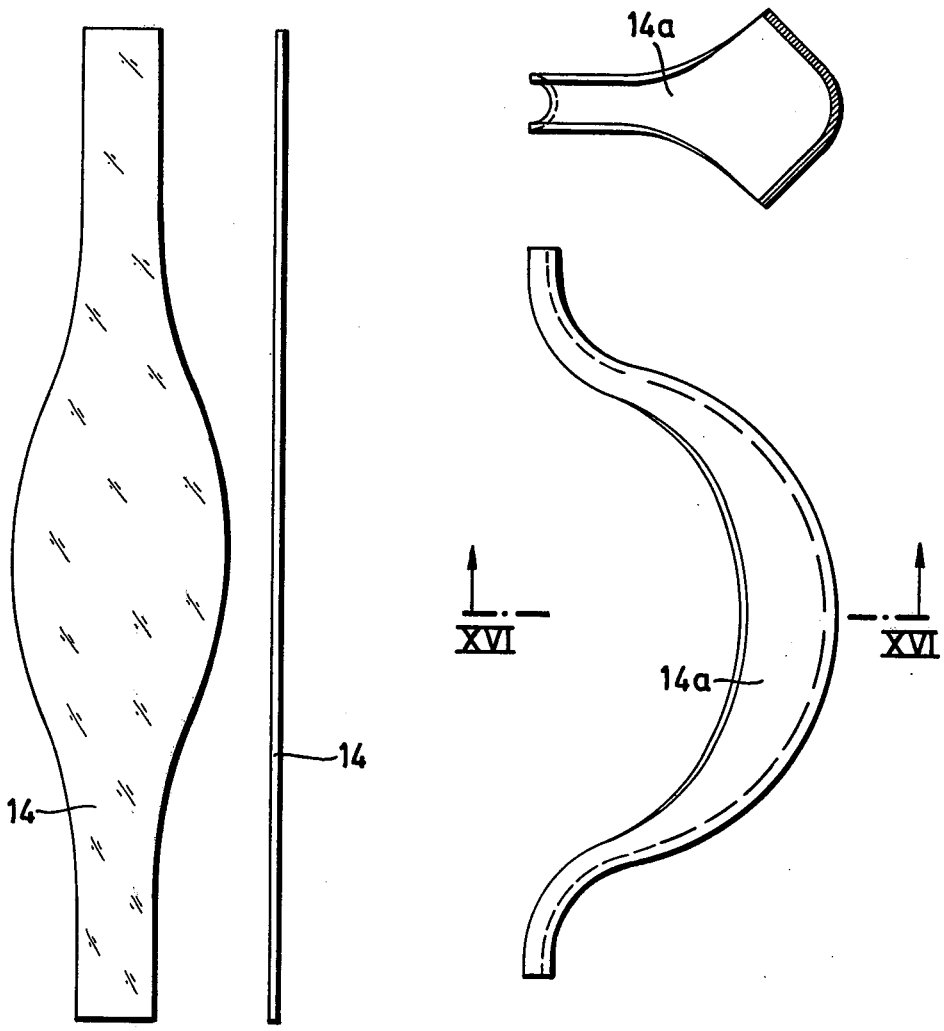
FIG. 14 is a plan view showing a sheet strip for manufacturing the connecting elements.
FIG. 14*a* is a side view showing a sheet strip of FIG. 14.
FIG. 15 is a view showing a portion of the connecting element which is manufactured by a pressing process and is curved along two axes.
FIG. 16 is a view showing a section taken along line XV—XV of FIG. 15.

The above-described members are constituted by pressed sheets. Sheet strips 14 which are used for manufacturing these members are shown in FIGS. 14 and 14*a* and have a convex form. The manufacture of these members is performed from these sheet strips by a pressing process in which the sheet strips are bent both in their longitudinal and transverse directions, as can be seen from FIGS. 15 and 16. The members diverge from their free ends connected with the frame members toward the spatial knot 15 and simultaneously become deeper. The curvature of the members of the thus-formed connecting elements is so selected that the members in their connecting region forming the knot 15 are flush with the outer sides, as is particularly shown in FIG. 13. The four members 14*a*–14*d* which together form the connecting elements 7, are connected with one another in the region of their common knot 15 by means of spot welding 9, so as to form an especially reliable shape-retaining spatial unit. The thus-formed spatial unit connecting the frame elements with one another is reliably fixed in its spatial location even under conditions of extremely high rock pressure, and even if in a given case the supporting frame is not reinforced by concrete but forms a permanent structure which remains in the mining gallery without concreting.

It will be understood that each of the elements described above, or two or more together, may also find a useful application in other types of constructions differing from the types described above.

While the invention has been illustrated and described as embodied in a wall supporting arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A wall supporting arrangement, especially for supporting mine gallery walls, comprising a supporting frame for a wall and including at least two frame elements spaced from one another in a direction transverse to the direction of elongation of the wall; and connecting means including a plurality of shape-retaining shell-shaped connecting elements distributed along said frame elments, each of said connecting elements including at least two shape-retaining shell portions each having two side edges facing away from the side edges of the other shell portion and connected with at least one of the frame elements, and a bottom wall facing toward and connected with the bottom wall of the other shell portion in the region which is located substantially centrally between said frame elements so that the latter are connected with one another in spatially fixed relationship and rigidly, both in the direction of elongation of the wall and in the transverse direction.

2. The arrangement as defined in claim 1, wherein said supporting frame includes a plurality of frame portions located laterally adjacent to one another and each having two such elongated frame elements connected by such shell-shaped connecting elements.

3. The arrangement as defined in claim 1, wherein said connecting elements are spaced from one another by irregular distances.

4. The arrangement as defined in claim 1, wherein said frame elements includes an outer frame element located adjacent to the wall to be supported, and an inner frame element inwardly spaced from said outer frame element.

5. The arrangement as defined in claim 1, wherein said frame elements have a trough-shaped cross-section.

6. The arrangement as defined in claim 1, wherein said shell-shaped connecting elements have a width as considered in a direction of elongation of said frame elements, and a depth as considered in a direction transverse to the direction of elongation of said frame elements, the width of said connecting elements exceeding the depth thereof.

7. The arrangement as defined in claim 4, wherein said supporting frame further includes another such outer frame element and another such inner frame element spaced from said first-mentioned outer frame element and said first-mentioned inner frame element in a direction of elongation of the wall, respectively, said connecting elements connecting said two outer frame elements and two inner frame elements with each other.

8. The arrangement as defined in claim 1, wherein the shell portions of each of said connecting elements are mirror-symmetrical.

9. The arrangement as defined in claim 1, wherein each of said shell portions has side walls extending from said bottom wall and inclined relative to the latter.

10. The arrangement as defined in claim 9, wherein said side walls diverge in a direction from said bottom wall toward said side edges.

11. The arrangement as defined in claim 9, wherein said side walls of said shell portions are inwardly convex.

12. The arrangement as defined in claim 1; and further comprising mounting means for connecting said frame elements to said side edges of said shell portions of said connecting elements, said mounting means including a corbel laterally extending beyond respective ones of said side edges and surrounding a respective one of said frame elements.

13. The arrangement as defined in claim 12, wherein said corbel surrounds said one frame element with interengaging relationship therewith and is fixed thereto; and further comprising fixing means for fixing said corbel to said one frame element.

14. The arrangement as defined in claim 12, wherein said side edges of each said shell portions has two side sections spaced from one another, said corbel being arranged at one of said side sections, said mounting means further including another such corbel arranged at another one of said side sections.

15. The arrangement as defined in claim 1, wherein the two shell portions of each of said shell-shaped connecting elements includes two shell sections, the four shell sections being secured crosswise with each other and diagonally connecting said frame elements with one another.

16. The arrangement as defined in claim 15, wherein said shell sections are convex both in a direction of elongation thereof and in a direction transverse to the direction of elongation thereof.

17. The arrangement as defined in claim 16, wherein each of said shell sections has an inner inwardly convex wall facing to and fastened with an inner convex wall of an adjacent shell section so as to form a shape-retaining spatial knot; and further including means for fastening said inner walls with one another.

18. The arrangement as defined in claim 17, wherein each of said shell sections has an outer convex wall at least partially surrounding a respective one of said frame elements and joined with the same in engaging relationship therewith; and further comprising joining means for joining said frame elements with said shell sections.

19. The arrangement as defined in claim 15, wherein each of said shell sections is convex in directions of two axes.

20. The arrangement as defined in claim 17, wherein said four shell sections connect the four such frame elements with each other so as to form a composite section, said spatial knot being located in a geometrical center of said composite section.

21. The arrangement as defined in claim 17, wherein said knot has a center, said four shell sections being centrally symmetrical with respect to said center of said knot.

22. The arrangement as defined in claim 15, wherein each of said shell sections has a longitudinal axis and a width increasing in an axial direction inwardly of a respective one of said connecting elements, each of said shell sections being convex in the axial direction and in a direction transverse to said axis.

23. The arrangement as defined in claim 18, wherein said outer walls of said shell sections have outer regions by which they are connected with said frame elements, said outer walls of each of said shell sections diverging in a direction from said outer regions toward said knot and said shell sections becoming deeper in the direction from said outer regions of said outer walls toward said knot.

24. The arrangement as defined in claim 18, wherein said outer walls and said inner walls are curved so that adjacent ones thereof are flush with one another in the regions of connection of adjacent ones of said walls with one another.

25. The arrangement as defined in claim 2, wherein each of said frame portions has two side ends circumferentially spaced from one another and each provided with a flange member abutting against a flange member of an adjacent one of said frame portions and flush therewith.

26. The arrangement as defined in claim 1, wherein said frame elements form a first group of elements and said connecting elements form a second group of elements; and further comprising anchoring means for anchoring said supporting frame to the wall to be supported and including anchoring members engaging the elements of at least one of said groups of elements.

27. The arrangement as defined in claim 1, wherein each of said shell sections is solid and extends in the transverse direction, the shell sections of each connecting elements being convex and located adjacent to one another in the direction of elongation of the wall, so that each of said connecting elements is a solid unitary structure extending both in the direction of elongation of the wall and in the transverse direction.

* * * * *